US009865233B2

(12) United States Patent
Kwa et al.

(10) Patent No.: US 9,865,233 B2
(45) Date of Patent: Jan. 9, 2018

(54) HYBRID GRAPHICS DISPLAY POWER MANAGEMENT

(75) Inventors: Seh W. Kwa, Saratoga, CA (US); James P. Kardach, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 676 days.

(21) Appl. No.: 12/346,759

(22) Filed: Dec. 30, 2008

(65) Prior Publication Data

US 2010/0164968 A1 Jul. 1, 2010

(51) Int. Cl.
*G09G 5/36* (2006.01)
*G09G 5/00* (2006.01)

(52) U.S. Cl.
CPC ..... *G09G 5/36* (2013.01); *G09G 5/003* (2013.01); *G09G 2320/103* (2013.01); *G09G 2330/021* (2013.01); *G09G 2360/06* (2013.01); *G09G 2360/10* (2013.01); *G09G 2360/18* (2013.01)

(58) Field of Classification Search
None
See application file for complete search history.

(56) References Cited

U.S. PATENT DOCUMENTS 5,864,336 A * 1/1999 Yano ..... 713/321
5,909,225 A 6/1999 Schinnerer et al.
5,916,302 A * 6/1999 Dunn et al. ..... 709/204
5,919,263 A 7/1999 Kikinis et al.
6,166,748 A 12/2000 Van et al.
6,624,816 B1 * 9/2003 Jones, Jr. ..... 345/503
6,657,634 B1 12/2003 Sinclair et al.
6,948,079 B2 9/2005 Zhang et al.
6,967,659 B1 11/2005 Jayavant et al.
7,017,053 B2 3/2006 Mizuyabu et al.
7,558,264 B1 7/2009 Lolayekar et al.
7,698,579 B2 * 4/2010 Hendry et al. ..... 345/502
7,698,581 B2 4/2010 Oh
7,839,860 B2 11/2010 Kobayashi
7,864,695 B2 1/2011 Morinaga et al.
7,867,799 B2 1/2011 Hooper et al.
(Continued)

FOREIGN PATENT DOCUMENTS

CN 1542602 A 11/2004
CN 1723430 A 1/2006
(Continued)

OTHER PUBLICATIONS

Office Action Received for Korean Patent Application No. 2009-0130812, dated Dec. 29, 2011, 3 pages of English Translation only.
(Continued)

*Primary Examiner* — Maurice L McDowell, Jr.
*Assistant Examiner* — Donna J Ricks
(74) *Attorney, Agent, or Firm* — Alpine Technology Law Group LLC

(57) ABSTRACT

Some embodiments describe techniques that relate to hybrid graphics display power management. In one embodiment, data corresponding to one or more image frames of a video stream are stored in a local frame buffer. A display device (e.g., an LCD) may then be driven based on the stored data in the local frame buffer or a video stream from a graphics controller. Other embodiments are also described.

28 Claims, 6 Drawing Sheets

(56) References Cited

U.S. PATENT DOCUMENTS

| | | | | |
|---|---|---|---|---|
| 7,961,656 | B2 | 6/2011 | Kwa et al. | |
| 8,121,060 | B2 | 2/2012 | Kwa et al. | |
| 8,259,119 | B1 * | 9/2012 | Diard | 345/502 |
| 8,274,501 | B2 | 9/2012 | Kwa et al. | |
| 8,411,586 | B2 | 4/2013 | Kwa et al. | |
| 8,743,105 | B2 | 6/2014 | Kwa et al. | |
| 2003/0210248 | A1 * | 11/2003 | Wyatt | 345/541 |
| 2004/0199798 | A1 | 10/2004 | Whelan et al. | |
| 2005/0005088 | A1 * | 1/2005 | Yearsley et al. | 712/235 |
| 2006/0147121 | A1 * | 7/2006 | Maeda et al. | 382/233 |
| 2007/0091359 | A1 | 4/2007 | Suzuki et al. | |
| 2007/0150616 | A1 | 6/2007 | Baek et al. | |
| 2007/0222774 | A1 | 9/2007 | Foster | |
| 2007/0283175 | A1 | 12/2007 | Marinkovic et al. | |
| 2008/0001934 | A1 | 1/2008 | Wyatt | |
| 2008/0001943 | A1 | 1/2008 | Park | |
| 2008/0008172 | A1 | 1/2008 | Kobayashi | |
| 2008/0034238 | A1 | 2/2008 | Hendry et al. | |
| 2008/0095151 | A1 | 4/2008 | Kawazoe et al. | |
| 2008/0143695 | A1 | 6/2008 | Juenemann et al. | |
| 2008/0168285 | A1 | 7/2008 | de Cesare et al. | |
| 2009/0079746 | A1 * | 3/2009 | Howard et al. | 345/502 |
| 2009/0093518 | A1 | 4/2009 | Plettenburg et al. | |
| 2009/0125940 | A1 | 5/2009 | Kim et al. | |
| 2009/0158377 | A1 | 6/2009 | Diab et al. | |
| 2010/0017526 | A1 * | 1/2010 | Jagannath et al. | 709/229 |
| 2010/0080218 | A1 | 4/2010 | Kwa et al. | |
| 2010/0087932 | A1 | 4/2010 | Mccoy et al. | |
| 2010/0091025 | A1 * | 4/2010 | Nugent et al. | 345/502 |
| 2010/0123727 | A1 | 5/2010 | Kwa et al. | |
| 2010/0138675 | A1 * | 6/2010 | Nikazm et al. | 713/300 |
| 2010/0141664 | A1 * | 6/2010 | Rawson et al. | 345/502 |
| 2011/0243035 | A1 | 10/2011 | Hall et al. | |
| 2012/0079295 | A1 | 3/2012 | Hayek et al. | |
| 2012/0117285 | A1 | 5/2012 | Kwa et al. | |
| 2014/0104286 | A1 | 4/2014 | Kwa et al. | |
| 2014/0104290 | A1 | 4/2014 | Kwa et al. | |
| 2014/0111531 | A1 | 4/2014 | Kwa et al. | |

FOREIGN PATENT DOCUMENTS

| | | | |
|---|---|---|---|
| CN | 101088116 | A | 12/2007 |
| CN | 101715119 | A | 5/2010 |
| CN | 101819510 | A | 9/2010 |
| JP | 5-273950 | A | 10/1993 |
| JP | 2000-507365 | A | 6/2000 |
| JP | 2001-016221 | A | 1/2001 |
| JP | 2001-016222 | A | 1/2001 |
| JP | 2003-050571 | A | 2/2003 |
| JP | 2003-140630 | A | 5/2003 |
| JP | 2003-222990 | A | 8/2003 |
| JP | 2004-503859 | A | 2/2004 |
| JP | 2005-027120 | A | 1/2005 |
| JP | 2006-268738 | A | 10/2006 |
| JP | 2007-293296 | A | 11/2007 |
| JP | 2008-084366 | A | 4/2008 |
| JP | 2008-109269 | A | 5/2008 |
| JP | 2008-182524 | A | 8/2008 |
| JP | 2010-512112 | A | 4/2010 |
| JP | 2010-102702 | A | 5/2010 |
| KR | 10-2006-0121987 | A | 11/2006 |
| KR | 10-2007-0041253 | A | 4/2007 |
| KR | 10-2008-0079290 | A | 8/2008 |
| KR | 10-2010-0036211 | A | 4/2010 |
| KR | 10-2010-0056397 | A | 5/2010 |
| KR | 10-2012-0039568 | A | 4/2012 |
| TW | 200625251 | | 7/2004 |
| TW | I243523 | B | 11/2005 |
| TW | 200746782 | A | 12/2007 |
| TW | 201024993 | A | 7/2010 |
| TW | 201032063 | A | 9/2010 |
| TW | I383979 | B | 2/2013 |
| WO | 97/35296 | A1 | 9/1997 |
| WO | 01/97006 | A1 | 12/2001 |
| WO | 2008/016424 | A1 | 2/2008 |
| WO | 2008/070061 | A2 | 6/2008 |

OTHER PUBLICATIONS

Office Action Received for Korean Patent Application No. 2009-0130812, dated Mar. 17, 2011, 4 pages of Office Action and 2 pages of English Translation.

Office Action Received for Chinese Patent Application No. 200910215942.0, dated Dec. 23, 2011, 6 pages of Office Action and 9 pages of English Translation.

Office Action Received for Japanese Patent Application No. 2009-287634, dated Apr. 3, 2012, 3 pages of Office Action and 2 pages of English Translation.

Office Action Received for German Patent Application No. 10 2009 058 274.6, dated Apr. 19, 2012, 5 pages of English Translation only.

Office Action Received for Chinese Patent Application No. 200910222296.0, dated Sep. 28, 2011, 9 pages of Office Action and 8 pages of English Translation.

Office Action Received for Chinese Patent Application No. 200910222296.0, dated Jun. 20, 2012, 5 pages of Office Action and 6 pages of English Translation.

Office Action Received for Korean Patent Application No. 10-2009-111387, dated Mar. 9, 2011, 5 pages of Office Action and 4 pages of English Translation.

Office Action Received for Korean Patent Application No. 10-2009-111387, dated Jan. 30, 2012, 4 pages of Office Action and 4 pages of English Translation.

Office Action Received of U.S. Appl. No. 12/313,257, dated Sep. 29, 2011, 13 pages.

Office Action Received of U.S. Appl. No. 12/313,257, dated Mar. 14, 2012, 13 pages.

Notice of Allowance Received of U.S. Appl. No. 12/313,257, dated May 24, 2012, 7 pages.

"VESA Embedded DisplayPort Standard", Video Electronics Standards Association (VESA), Version 1.3, Jan. 13, 2011, pp. 1-81.

"Section 2.2.5.4 Extension Packet, VESA DisplayPort Standard", Video Electronics Standards Association, Version 1, Revision 1a, Jan. 11, 2008, pp. 5-9.

Panel Standardization Working Group, "Industry Standard Panels for Monitors-15.0-inch", Mounting and Top Level Interface Requirements, Panel Standardization Working Group, Version 1.1, Mar. 12, 2003, pp. 1-19.

Office Action Received of U.S. Appl. No. 12/286,192, dated Apr. 29, 2010, 7 pages.

Notice of Allowance Received of U.S. Appl. No. 12/286,192, dated Oct. 1, 2010, 5 pages.

Notice of Allowance Received of U.S. Appl. No. 12/286,192, dated Jan. 19, 2011, 7 pages.

Office Action Received for Chinese Patent Application No. 200910221453.6, dated Oct. 10, 2011, 4 pages of Office Action and 4 pages of English Translation.

Office Action Received for Korean Patent Application No. 10-2009-92283, dated Feb. 12, 2011, 3 pages of Office Action and 2 pages of English Translation.

Office Action Received for Korean Patent Application No. 10-2009-92283, dated Oct. 27, 2011, 3 pages of Office Action and 4 pages of English Translation.

Office Action Received for Korean Patent Application No. 10-2009-92283, dated Apr. 9, 2012, 4 pages of Office Action and 4 pages of English Translation.

Office Action Received for Japanese Patent Application No. 2009-222990, dated Aug. 2, 2011, 2 pages of Office Action and 2 pages of English Translation.

Notice of Allowance Received for Japanese Patent Application No. 2009-222990, dated Jan. 31, 2012, 1 page of Notice of Allowance only.

Office Action Received for U.S. Appl. No. 13/089,731, dated Jul. 22, 2011, 13 pages.

Notice of Allowance Received for U.S. Appl. No. 13/089,731, dated Oct. 20, 2011, 18 pages.

(56) References Cited

OTHER PUBLICATIONS

Office Action Received for U.S. Appl. No. 13/349,276, dated Jul. 2, 2012, 17 pages.
"VESA Embedded DisplayPort (eDP)", VESA eDP Standard, Copyright 2008 Video Electronics Standards Association, Version 1, Dec. 22, 2008, pp. 1-23.
"VESA Embedded DisplayPort (eDP) Standard", Embedded DisplayPort, Copyright 2008-2009 Video Electronics Standards Association, Version 1.1, Oct. 23, 2009, pp. 1-32.
"VESA Embedded DisplayPort Standard", eDP Standard, Copyright 2008-2010, Video Electronics Standards Association, Version 1.2, May 5, 2010, pp. 1-53.
Office Action Received for Chinese Patent Application No. 200910215942.0, dated Jun. 20, 2012, 3 pages of Office Action and 4 pages of English Translation.
Office Action received for Korean Patent Application No. 10-2009-0130812, dated Sep. 25, 2012, 1 page of English Translation and 2 pages of Office Action.
Office Action received for U.S. Appl. No. 13/625,185, dated Feb. 21, 2013, 10 pages.
Notice of Allowance received for U.S. Appl. No. 13/625,185, dated Jun. 28, 2013, 9 pages.
Office Action received for Taiwan Patent Application No. 098138973, dated Feb. 25, 2013, 1 page of Search Report and 12 pages of Office Action.
Office Action received for Chinese Patent Application No. 200910222296.0, dated Oct. 30, 2012, 4 pages of English Translation and 3 pages of Office Action.
Notice of Grant received for Chinese Patent Application No. 200910222296.0, dated Mar. 6, 2013, 2 pages of English Translation and 2 pages of Grant.
Office Action received for Japanese Patent Application No. 2012-031772, dated May 14, 2013, 2 pages of English Translation and 2 pages of Office Action.
Office Action received for Korean Patent Application No. 10-009-0092283, dated Oct. 31, 2012, 2 pages of English Translation and 3 pages of Office Action.
Notice of Grant received for Chinese Patent Application No. 200910221453.6, dated Mar. 15, 2013, 1 page of English Translation and 6 pages of Grant including Search Report.
Office Action received for Chinese Patent Application No. 200910221453.6, dated Jul. 23, 2012, 2 pages of English Translation and 3 pages of Office Action.
Notice of Allowance received for U.S. Appl. No. 13/349,276, dated Nov. 16, 2012, 11 pages.
Office Action received for Taiwan Patent Application No. 098142926, dated Jun. 10, 2013, 8 pages of English Translation and 7 pages of Office Action including Search Report.
Notice of Allowance received for Chinese Patent Application No. 200910215942.0, dated Mar. 25, 2013, 2 pages of Grant only.
Notice of Allowance received for Japanese Patent Application No. 2009-287634, dated Mar. 19, 2013, 3 pages of Grant only.
Office Action received for Japanese Patent Application No. 2009-287634, dated Oct. 9, 2012, 2 pages of English Translation and 3 pages of Japanese Office Action.
Notice of Allowance received for Taiwan Patent Application No. 098142926, dated Sep. 26, 2013, 2 pages of Notice of Allowance only.
Office Action received for Taiwan Patent Application No. 098132686, dated Nov. 5, 2013, 5 pages of Office Action only.
Office Action received for Taiwan Patent Application No. 098132686, dated Dec. 26, 2012, 19 pages of Office Action including 1 page of Search Report.
Notice of Allowance received for Taiwan Patent Application No. 098138973, dated Nov. 22, 2013, 1 page of English Translation and 2 pages of Notice of Allowance.
Notice of Grant received for Japanese Patent Application No. 2012-031772, dated May 27, 2014, 1 page of Notice of Grant only.
Office Action received for Chinese Patent Application No. 201310233668.6, dated Mar. 27, 2015, 16 pages including 10 pages of English translation.
Office Action received for Chinese Patent Application No. 201310233668.6, dated May 24, 2016, 7 pages including 4 pages of English translation.
Office Action received for Chinese Patent Application No. 201310233668.6, dated Dec. 15, 2015, 9 pages including 6 pages of English translation.
Office Action received for Chinese Patent Application No. 201310233668.6, dated Jan. 23, 2017, 16 pages including 10 pages of English Translation.
"Display Port 1.2 Technology AMD FirePro V7900 and V5900 Professional Graphics", White Paper, 2011, 9 pages, Advanced Micro Devices Inc.
"Display Port" Wikipedia Entry, Retrieved Feb. 7, 2017, 18 pages, retrieved from https://en.wikipedia.org/wiki/DisplayPort.
Kobayashi, "DisplayPort Ver.1.2 Overview", Conference, Dec. 6, 2010, 34 pages, VESA, Taipei, Taiwan.
Wiley, "eDP Embedded Display Port; The New Generation of Digital Display Interface for Embedded Applications", Conference, Dec. 6, 2010, 30 pages, VESA, Taipei, Taiwan.
"DisplayPort v1.3", Feature Summary, Sep. 18, 2014, 14 pages, VESA.
Wiley, "DisplayPort Technical Overview", Conference, Jan. 10, 2011, 40 pages, VESA, Las Vegas, NV.
"Embedded DisplayPort 1.4 Test Solution", 2016, 4 pages, Teledyne LeCroy Inc.
"VESA DisplayPort Standard", Standard, Jan. 11, 2008, 238 pages, Version 1 Revision 1a, VESA, Milpitas, CA.
Choate, "DisplayPortTechnology Update", Jun. 15, 2016, 38 pages, VESA.
Office Action received for German Patent Application No. 10 2009 058 274.6, dated May 24, 2017, 14 pages.
Office Action received for Chinese Patent Application No. 201310233668.6, dated Sep. 6, 2017, 16 pages including 11 pages of English translation.

* cited by examiner

HYBRID GRAPHICS DISPLAY POWER MANAGEMENT

FIELD

The present disclosure generally relates to the field of electronics. More particularly, an embodiment of the invention relates to hybrid graphics display power management.

BACKGROUND

Portable computing devices are gaining popularity, in part, because of their decreasing prices and increasing performance. Another reason for their increasing popularity may be due to the fact that some portable computing devices may be operated at many locations, e.g., by relying on battery power. However, as more functionality is integrated into portable computing devices, the need to reduce power consumption becomes increasingly important, for example, to maintain battery power for an extended period of time.

Moreover, some portable computing devices include a liquid crystal display (LCD) or "flat panel" display. Today's mobile devices are generally designed to be "always ready" for updating new frames on the display. While this state of readiness may be great for visual performance requirements, the power incurred becomes wasteful when the system is idle (e.g., while the image on the display does not change for a given time period).

BRIEF DESCRIPTION OF THE DRAWINGS

The detailed description is provided with reference to the accompanying figures. In the figures, the left-most digit(s) of a reference number identifies the figure in which the reference number first appears. The use of the same reference numbers in different figures indicates similar or identical items.

DETAILED DESCRIPTION

In the following description, numerous specific details are set forth in order to provide a thorough understanding of various embodiments. However, some embodiments may be practiced without the specific details. In other instances, well-known methods, procedures, components, and circuits have not been described in detail so as not to obscure the particular embodiments.

Some of the embodiments discussed herein may provide a novel techniques and architecture that would be power efficient and/or scalable (to different size displays and/or display local frame buffer), while maintaining graphics performance. In an embodiment, a switching component and associated logic may be integrated into one or more graphics devices (such as an associated chipset, processor, display device, graphics logic, etc.) to facilitate display power optimization, for example, by entering self-refresh or switching from discrete graphics to integrated graphics (also referred to herein as GFX (Graphic Effects)) during idle period(s). As discussed herein, "idle" period(s) refer to when a displayed image does not change for a select time period, such as 1 ms, shorter or longer period, etc. In one embodiment, a portion of memory (e.g., a graphics memory or a system memory) may be utilized for context switching to facilitate smoother transition between discrete graphics and integrated graphics.

Figure 1:
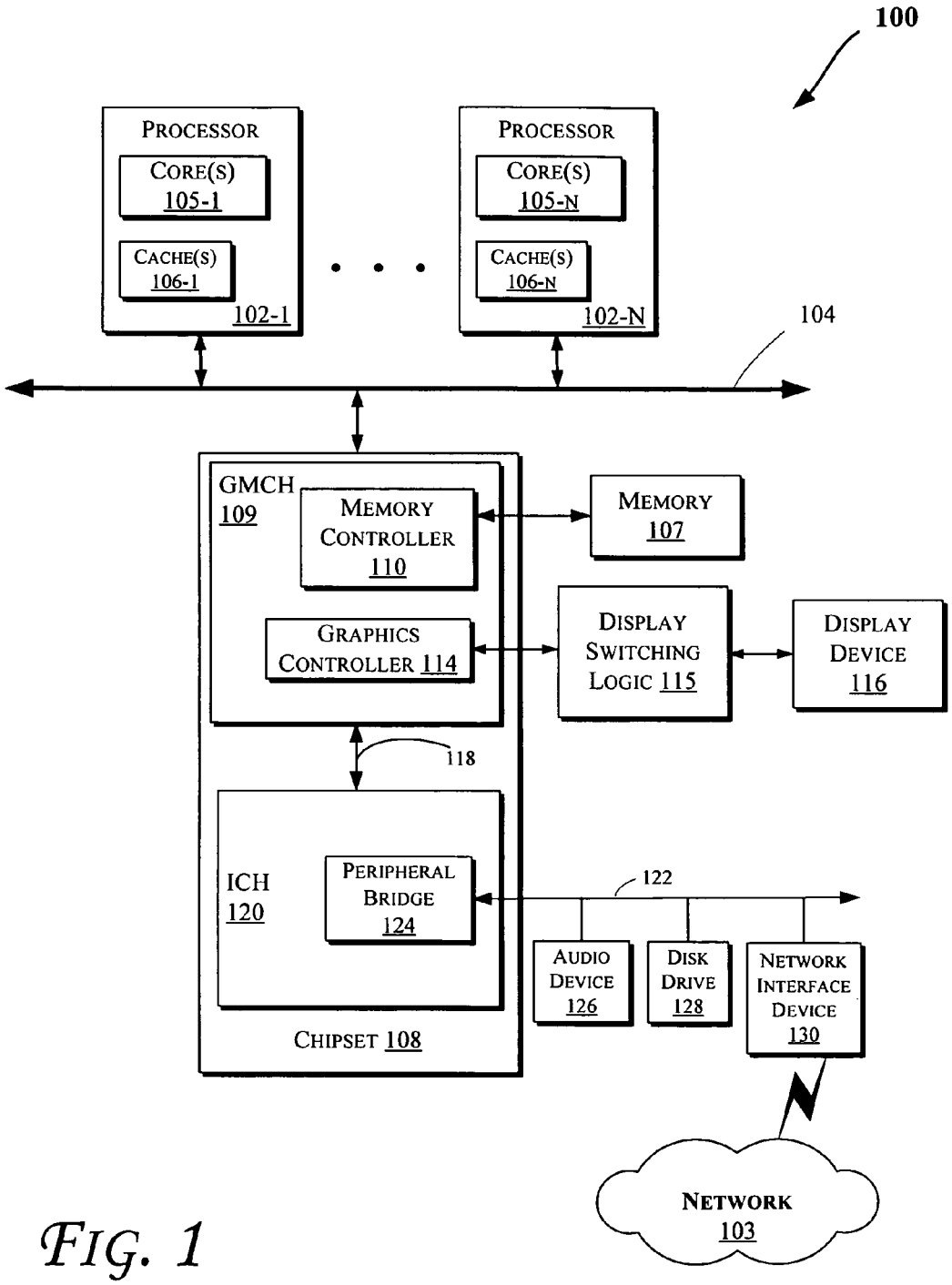
FIGS. 1, 2, and 7 illustrate block diagrams of embodiments of computing systems, which may be utilized to implement various embodiments discussed herein.

In some embodiments, integrated graphics refers to graphics logic that may be integrated with one or more core system components (such as processor, chipset on a motherboard, etc.), whereas discrete graphics may refer to graphics logic that is provided on a separate interface device (such as an interface card) coupled to the other computing system figures via a bus/interconnect or a point-to-point connection (including for example, PCI, PCI Express, etc.), such as discussed further herein, e.g., with reference to FIGS. 1-7. Furthermore, some of the embodiments discussed herein may be utilized in various computing systems such as those discussed with reference to FIGS. 1-7. More particularly, FIG. 1 illustrates a block diagram of a computing system 100 in accordance with an embodiment of the invention. The computing system 100 may include one or more central processing unit(s) (CPUs) or processors 102-1 through 102-N (collectively referred to here in as "processor 102" or "processors 102") that communicate via an interconnection network (or bus) 104. The processors 102 may include a general purpose processor, a network processor (that processes data communicated over a computer network 103), or other types of a processor (including a reduced instruction set computer (RISC) processor or a complex instruction set computer (CISC)).

Moreover, the processors 102 may have a single or multiple core design, e.g., one or more of the processors 102 may include one or more processor cores 105-1 through 105-N (collectively referred to here in as "core 105" or "cores 105"). The processors 102 with a multiple core design may integrate different types of processor cores 105 on the same integrated circuit (IC) die. Also, the processors 102 with a multiple core design may be implemented as symmetrical or asymmetrical multiprocessors.

In an embodiment, one or more of the processors 102 may include one or more caches 106-1 through 106-N (collectively referred to here in as "cache 106" or "caches 106"). The cache 106 may be shared (e.g., by one or more of the cores 105) or private (such as a level 1 (L1) cache). Moreover, the cache 106 may store data (e.g., including instructions) that are utilized by one or more components of the processors 102, such as the cores 105. For example, the cache 106 may locally cache data stored in a memory 107 (also referred to herein as system memory) for faster access by components of the processor 102. In an embodiment, the cache 106 (that may be shared) may include a mid-level cache and/or a last level cache (LLC). Various components of the processors 102 may communicate with the cache 106 directly, through a bus or interconnection network, and/or a memory controller or hub.

A chipset 108 may also communicate with the interconnection network 104. The chipset 108 may include a graphics and memory control hub (GMCH) 109. The GMCH 109 may include a memory controller 110 that communicates with the memory 107. The memory 107 may store data, including sequences of instructions that are executed by the processors 102, or any other device included in the computing system 100. In one embodiment of the invention, the memory 107 may include one or more volatile storage (or memory) devices such as random access memory (RAM), dynamic RAM (DRAM), synchronous DRAM (SDRAM), static RAM (SRAM), or other types of storage devices. Nonvolatile memory may also be utilized such as a hard disk. Additional devices may communicate via the interconnection network 104, such as multiple system memories.

The GMCH 109 may also include a graphics interface controller 114 and a display switching logic 115. As will be further discussed herein, e.g., with reference to FIGS. 2-6, the logic 115 may cause the switching between discrete graphics, integrated graphics, or self-refresh mode for a display device 116. Also, the logic 115 may be provided in various locations depending on the implementation, including but not limited to, the chipset 108, graphics controller 114, display device 116, etc. The graphics interface controller 114 may communicate with the display device 116, e.g., to display one or more image frames corresponding to data stored in the memory 107, data received from the network 103, data stored in disk drive 128, data stored in cache(s) 106, data processed by processor(s) 102, etc. The graphics controller 114 may include integrated graphics, discrete graphics, or both. Also, graphics controller 114 may be integrated into the system 100 (e.g., on a motherboard, the chipset 108 (such as shown), etc.) or provided on a separate interface, such as an interface card (coupled to the system 100 components via point-to-point or shared interconnections, including bus 104 and/or 122).

The display device 116 may be any type of a display device, such as a flat panel display (including an LCD, a field emission display (FED), or a plasma display) or a display device with a cathode ray tube (CRT). In one embodiment of the invention, the graphics interface controller 114 may communicate with the display device 116 via a low voltage differential signal (LVDS) interface, DisplayPort (which is a digital display interface standard (approved May 2006, current version 1.1 approved on Apr. 2, 2007) put forth by the Video Electronics Standards Association (VESA)), a digital video interface (DVI), or a high definition multimedia interface (HDMI). Also, the display device 116 may communicate with the graphics interface controller 114 through, for example, a signal converter that translates a digital representation of an image stored in a storage device such as video memory (e.g., coupled to the GMCH 109 or display device 116 (not shown)) or system memory (e.g., memory 107) into display signals that are interpreted and displayed by the display device 116.

A hub interface 118 may allow the GMCH 109 and an input/output control hub (ICH) 120 to communicate. The ICH 120 (which may also be referred to herein as a platform control hub (PCH) may provide an interface to I/O devices that communicate with the computing system 100. The ICH 120 may communicate with a bus 122 through a peripheral bridge (or controller) 124, such as a peripheral component interconnect (PCI) bridge, a universal serial bus (USB) controller, or other types of peripheral bridges or controllers. The bridge 124 may provide a data path between the CPU 102 and peripheral devices. Other types of topologies may be utilized. Also, multiple buses may communicate with the ICH 120, e.g., through multiple bridges or controllers. Moreover, other peripherals in communication with the ICH 120 may include, in various embodiments of the invention, integrated drive electronics (IDE) or small computer system interface (SCSI) hard drive(s), USB port(s), a keyboard, a mouse, parallel port(s), serial port(s), floppy disk drive(s), digital output support (e.g., digital video interface (DVI)), or other devices.

The bus 122 may communicate with an audio device 126, one or more disk drive(s) 128, and a network interface device 130 (which is in communication with the computer network 103). Other devices may communicate via the bus 122. Also, various components (such as the network interface device 130) may communicate with the GMCH 109 in some embodiments of the invention. In addition, the processor 102 and the GMCH 109 may be combined to form a single chip. Furthermore, the graphics controller 114 and/or logic 115 may be included within the display device 116 in other embodiments of the invention.

Furthermore, the computing system 100 may include volatile and/or nonvolatile memory (or storage). For example, nonvolatile memory may include one or more of the following: read-only memory (ROM), programmable ROM (PROM), erasable PROM (EPROM), electrically erasable EPROM (EEPROM), a disk drive (e.g., disk drive 128), a floppy disk, a compact disk ROM (CD-ROM), a digital versatile disk (DVD), flash memory, a magneto-optical disk, or other types of nonvolatile machine-readable media that are capable of storing electronic data (e.g., including instructions).

Figure 2:
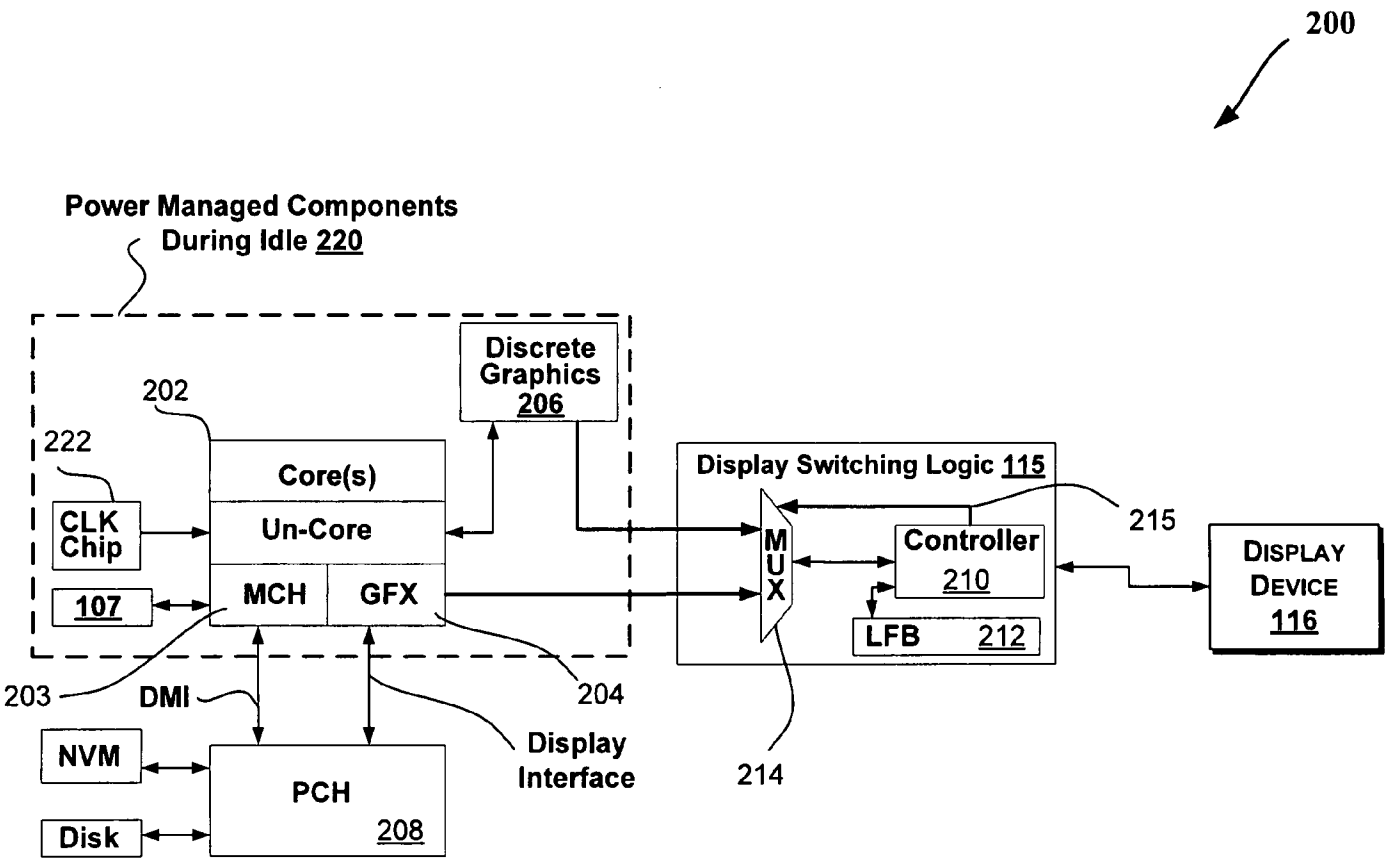

FIG. 2 illustrates a block diagram of portions of a computing system 200, according to an embodiment of the invention. As shown in FIG. 2, the system 200 may include the logic 115, display device 116, a processor 202 (for example, having one or more cores and an un-core, where an MCH 203 (which may be the same or similar to the GMCH of FIG. 1) and GFX 204 may be implemented within the processor 202 or as separate components on the same integrated circuit chip or on a separate chip), a PCH 208 (which may be the same or similar to the ICH 120 of FIG. 1, and for example coupled to a non-volatile memory (NVM), disk, etc.), a discrete graphics controller logic 206 (which as discussed with reference to FIG. 1 may be provided in various forms and locations). As shown, PCH 208 may respectively communicate with MCH 203 and GFX 204 through a Direct Media Interface (DMI) and a display interface (such as DisplayLink™ interface technology which allows for connection of computers and displays using USB and Wireless USB).

In some embodiments, at least some of the components shown in FIG. 2 may be embedded in a display panel or on a motherboard. The display switching logic 115 may include a controller 210, a Local Frame Buffer (LFB) 212, and a multiplexer (MUX) 214. The controller 210 may (e.g., based on an indication (such as a signal or a stored value in a register or memory location within the memory 107, or other memory/cache such as those discussed with reference to the figures herein) by the processor 202, GFX 204, and/or discrete graphics 206) switch the driving of the display device 116 in accordance with data from the LFB 212, GFX 204, and/or discrete graphics 206. As shown in FIG. 2, the controller 210 may provide a selection signal 215 to the MUX 214 to select between inputs from the GFX 204 or discrete graphics 206.

Alternatively, the controller 210 may utilize data from the LFB 212 to provide self-refresh of the display device 116. Doing so would afford the rest of the platform such as CPU/GPU (Central Processing Unit/Graphics Processing Unit) complex and/or discrete graphics 206 (e.g., items marked in box 220) and PCH 208 to be aggressively power managed (even turned off, e.g., by turning off the respective clock signal) in some embodiments. This may be particularly useful in addressing the leakage impact of high performance silicon manufactured in deep submicron CMOS (Complementary Metal Oxide Semiconductor) process technologies such as CPU-GPU complex and discrete graphics controllers. Furthermore the power impact of platform ingredients such as system memory, platform clock chip 222 (which may provide an operating clock signal to the processor 202 and/or other components of the system 200, or other computing systems discussed herein), and voltage regulators which regulate the supply voltage to the components of FIGS. 1-2 or 7 (not shown) may be reduced when these components are not performing any tasks.

Figure 4:
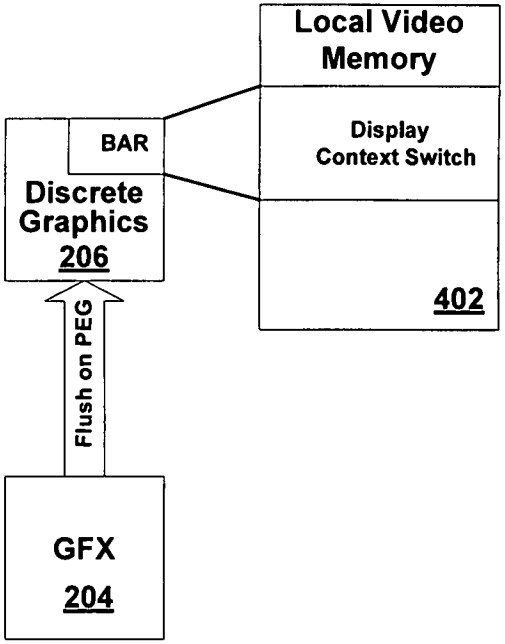
FIGS. 3-4 illustrate components associated with context switching between discrete graphics and integrated graphics, in accordance with some embodiments.
Figure 3:
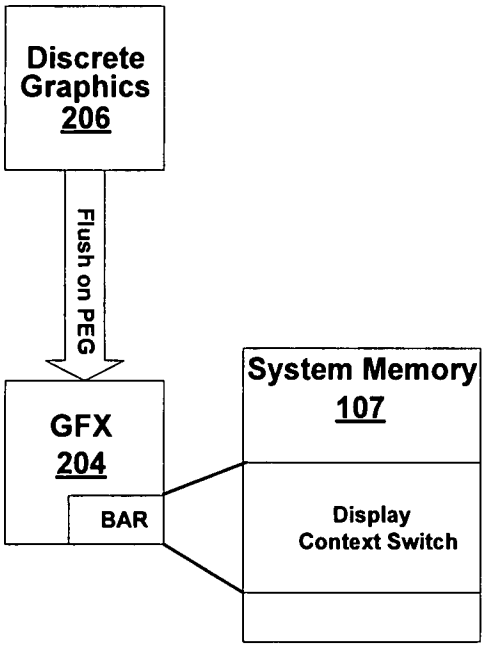

FIG. 3 illustrates components associated with context switching from discrete graphics to integrated graphics, in accordance with an embodiment. FIG. 4 illustrates components associated with context switching from integrated graphics to discrete graphics, in accordance with an embodiment. In some embodiments, utilization of the discrete graphics controller 206 may consume more power but improve performance relative to the integrated graphics controller 204. Similarly, utilization of the integrated graphics controller 204 may consume less power but reduce performance relative to the discrete graphics controller 206.

As shown in FIG. 3, once the discrete graphics controller 206 detects a need for switching to integrated graphics (e.g., based on an indication that the platform is to conserve power or reduce performance (such as low power consumption settings, low battery charge level conditions, low performance setting, etc.), controller 206 may cause a flush (e.g., of the current entire frame) to occur (e.g., through a PEG (PCI Express Graphics) port). The integrated graphics controller 204 may cause storage of data corresponding to the display context switching (e.g., including one or more image frames) into the system memory 107, so that the integrated graphics controller 204 may resume the display of graphics image with little or no interruption during the switching.

As shown in FIG. 4, once the integrated graphics controller 204 detects a need for switching to discrete graphics (e.g., based on an indication that the platform is to provide higher performance (such as high power consumption settings, presence of an Alternating Current (AC) adapter, execution of a graphics intensive application, etc.), it may cause a flush (e.g., of the current entire frame) to occur (e.g., through a PEG port). The integrated graphics controller 204 may cause storage of data corresponding to the display context switching (e.g., including one or more image frames) into a local video memory 402 accessible by the discrete graphics controller 206 (e.g., which may be provided on the same integrated circuit device as the controller 206), so that the discrete graphics controller 206 may resume the display of graphics image with little or no interruption during the switching. Memory 402 may be any type of a memory device including those discussed with reference to memory 107, or a RAM type device designed for storage of video data (such as Video RAM (VRAM)). In some embodiments, the display context switching data may be stored in the LFB 212.

In some embodiments, there are two protocol handshakes the components involved are to support to create the above-mentioned capabilities. First, the discrete graphics controller 206 and the integrated graphics controller 204 will facilitate the mechanism to define a memory region for context switching (as well as allow for software visible control of initiating the context switch in an embodiment). Doing so would allow for transparency in porting the current image on display between these graphics controllers for the purpose of hybrid graphics applications. For example, FIG. 3 illustrates the protocol mechanism for a definition of such memory region through configuration register(s) (denoted by BAR) and the initiation of streaming image content currently displayed on an idle system to perform the context switching. BAR can also be used for switching from the integrated graphics controller 204 to the discrete graphics controller 206, such as shown in FIG. 4. Furthermore, as shown in FIGS. 3 and 4, the configuration register(s) (denoted by BAR) may reside or be accessible by the graphics controller that is to resume driving the display data after a switch occurs (e.g., in GFX 204 for FIG. 3 and in controller 206 for FIG. 4).

Hence, storage of content switching data may preserve the content across graphics controller switches. The second function is to allow for the streaming of display content to the logic 115 including the switching between discrete and integrated graphics as well as a request and grant protocol for periodic content update to the logic 115 as the content in the local frame buffer 212 is drained. The latter is to facilitate scalability due to possible limitation in local frame buffer size, as well as flexibility in accommodating a wide range of display refresh rate and resolution.

Figure 5:
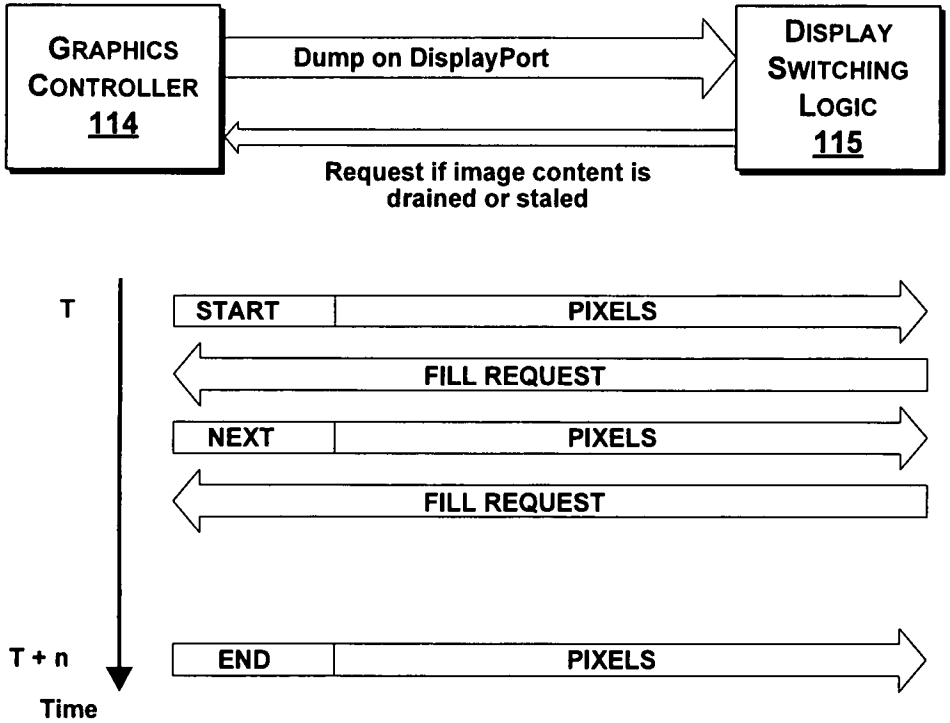
FIG. 5 illustrates a flow diagram of a scalability handshake protocol for display content update and storage, accordingly to an embodiment.

FIG. 5 illustrates a flow diagram of a scalability handshake protocol for display content update and storage, accordingly to an embodiment. As illustrated, FIG. 5 shows communication and data flow between a graphics controller (integrated or discrete) and the logic 115. In particular, data packets (e.g., with tags including start of frame, next data, and/or end of frame) are sent by the graphics controller 114 to fill the local frame buffer 212 in the logic 115. The logic 115 may in turn periodically request data fills as its buffer is drained below a threshold or the image has become stale through an event notification (e.g., resolution of the display device 116 is increased, partial frame change, etc.). Accordingly, in some embodiments, a periodic content update may be provided to allow for memory scalability with respect to display refresh rate and/or resolution.

Figure 6:
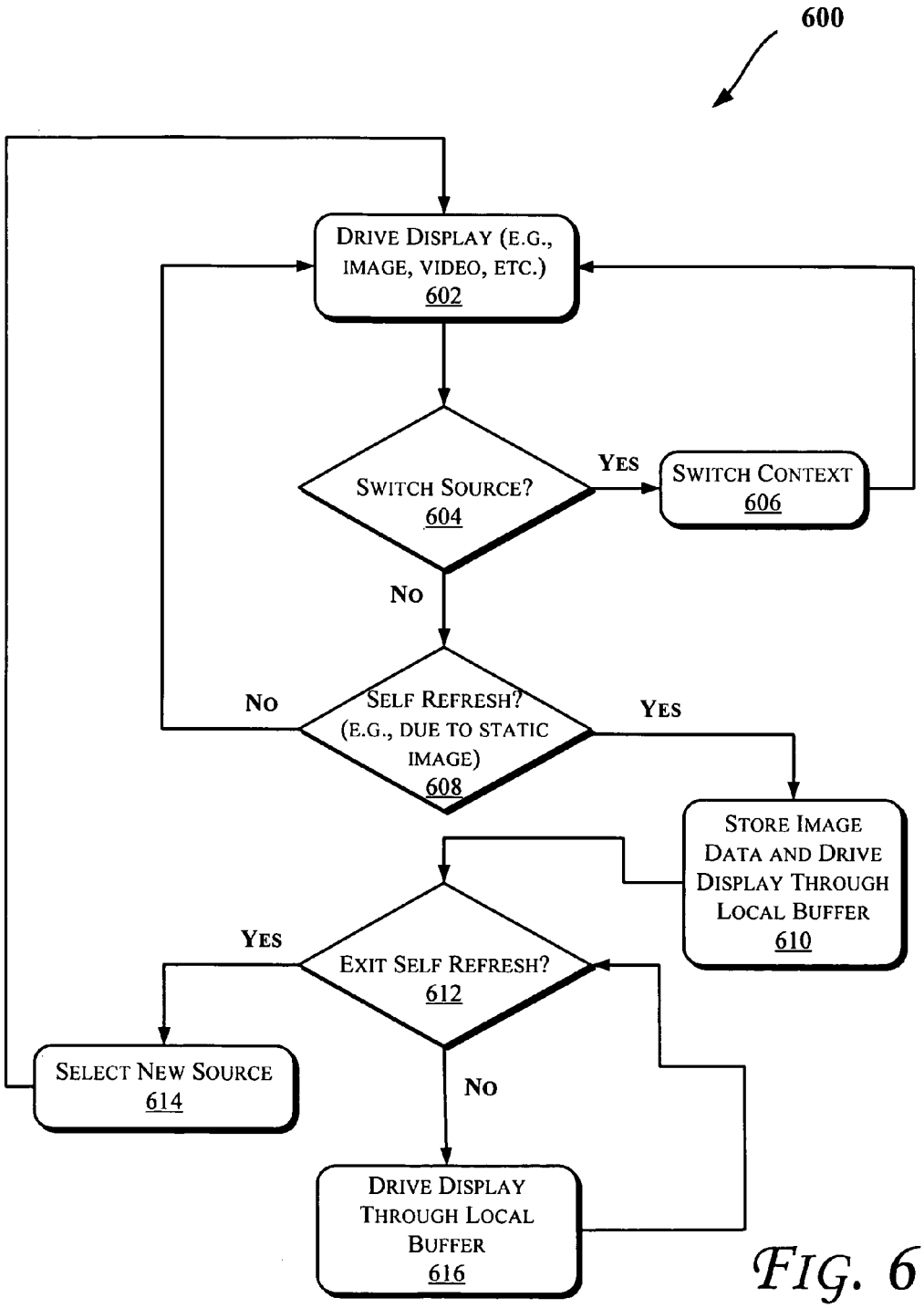
FIG. 6 illustrates a flow diagram of a method to modify the refresh rate of a display device, according to an embodiment.

FIG. 6 illustrates a flow diagram of an embodiment of a method 600 to perform hybrid graphics display power management, according to an embodiment of the invention. In an embodiment, various components discussed with reference to FIGS. 1-5 and 7 may be utilized to perform one or more of the operations discussed with reference to FIG. 6. For example, the method 600 may be used to modify the source of image frames to be displayed on the display device 116 in accordance with directions from the logic 115 of FIGS. 1-5 or 7.

Referring to FIGS. 1-6, at an operation 602, a display may be driven (e.g., display device 116 may be driven by controller 114 through logic 115), for example, to display image(s), video, etc. At an operation 604, it may be determined whether to switch the source of content for the display (e.g., based on data stored in the LFB 212, data from the GFX 204, the discrete graphics controller 206, processor 202, etc. as discussed with reference to FIGS. 1-5). If the source is to be switched, an operation 606 may switch context, for example, by storing context switching data (such as discussed with reference to FIGS. 3-4). If no source switching is to be performed, an operation 608 may determine whether display self-refresh is to occur (e.g., driving the display device 116 based on data stored in the LFB 212 rather than data from a graphics controller, a processor, etc.). As discussed herein, various situations/events may cause display self refresh, including for example presence of a static image for a select time period. If no self refresh is to occur, the method 600 resumes with operation 602; otherwise, at an operation 610, image data may be stored (e.g., by the controller 210 in the LFB 212) and the display is driven based on the locally stored data (e.g., driven by the controller 210 based on data stored in the LFB 212). Once an operation 612 (e.g., controller 210) determines that self-refresh is to be exited (e.g., based on a change in data to be displayed on the display 116 at the direction of a logic (such as GFX 204, discrete graphics 206, processor 202, etc.), an operation 614 may select a new source (e.g., via the multiplexer 214 such as discussed with reference to FIG. 2). Otherwise, self-refresh is maintained through operation 616.

Figure 7:
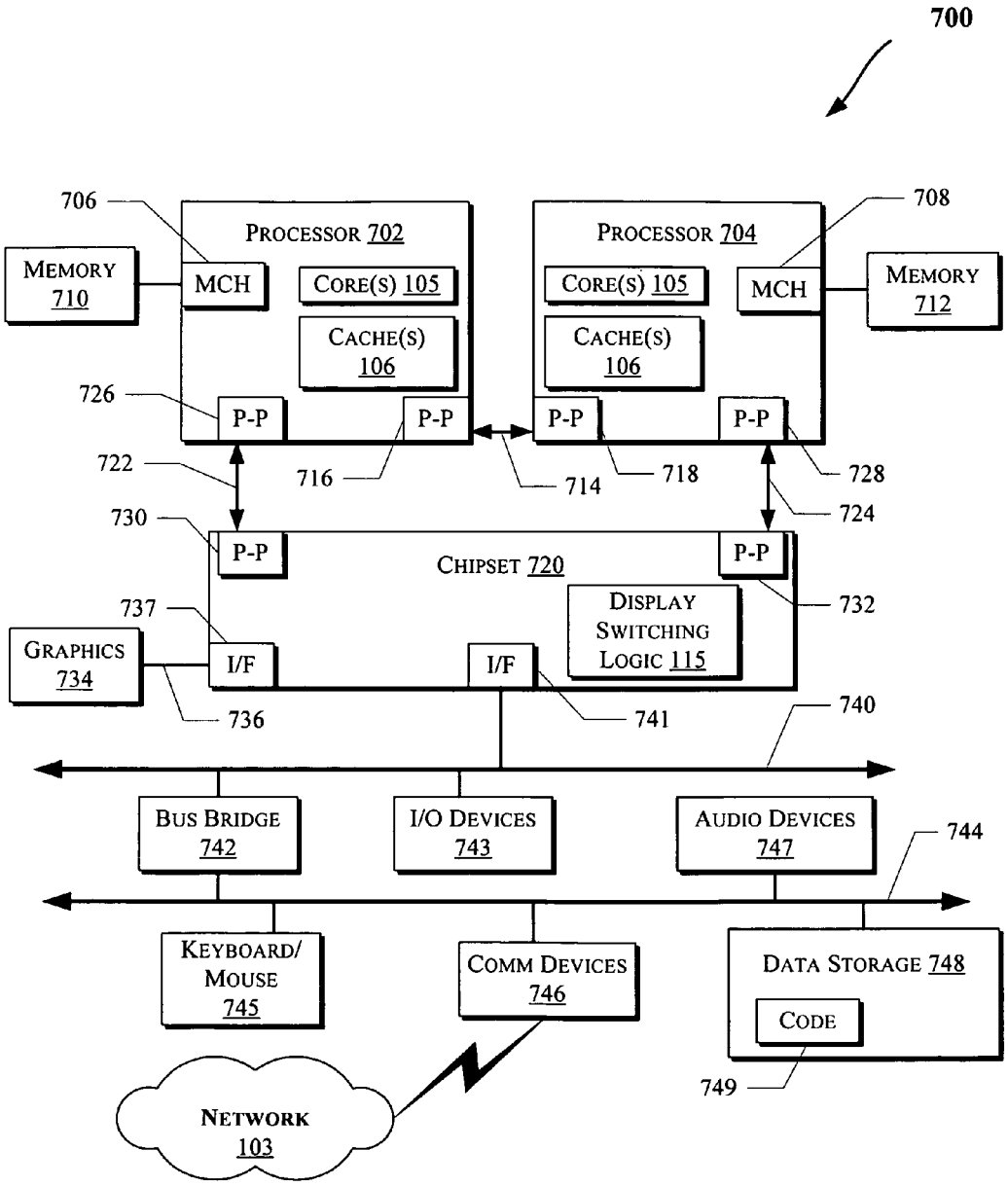

FIG. 7 illustrates a computing system 700 that is arranged in a point-to-point (PtP) configuration, according to an embodiment of the invention. In particular, FIG. 7 shows a system where processors, memory, and input/output devices are interconnected by a number of point-to-point interfaces. The operations discussed with reference to FIGS. 1-6 may be performed by one or more components of the system 700.

As illustrated in FIG. 7, the system 700 may include several processors, of which only two, processors 702 and 704 are shown for clarity. The processors 702 and 704 may each include a local memory controller hub (MCH) 706 and 708 to enable communication with memories 710 and 712. In an embodiment, the MCH 706 and/or 708 may be a GMCH such as discussed with reference to FIG. 1. The memories 710 and/or 712 may store various data such as those discussed with reference to the memory 107 of FIG. 1.

In an embodiment, the processors 702 and 704 may be one of the processors 102 discussed with reference to FIG. 1. The processors 702 and 704 may exchange data via a point-to-point (PtP) interface 714 using PtP interface circuits 716 and 718, respectively. Also, the processors 702 and 704 may each exchange data with a chipset 720 via individual PtP interfaces 722 and 724 using point-to-point interface circuits 726, 728, 730, and 732. The chipset 720 may further exchange data with a high-performance graphics circuit 734 via a high-performance graphics interface 736, e.g., using a PtP interface circuit 737. In an embodiment, the logic 115 may be provided in the chipset 720 although logic 115 may be provided elsewhere within the system 700 such as within processor(s) 702 and/or 704, within MCH/GMCH 706 and/or 708, etc. (such as discussed with reference to FIG. 1, for example). Also, one or more of the cores 105 and/or caches 106 of FIG. 1 may be located within the processors 702 and 704. Other embodiments of the invention may exist in other circuits, logic units, or devices within the system 700. Furthermore, other embodiments of the invention may be distributed throughout several circuits, logic units, or devices illustrated in FIG. 7.

The chipset 720 may communicate with a bus 740 using a PtP interface circuit 741. The bus 740 may have one or more devices that communicate with it, such as a bus bridge 742 and I/O devices 743. Via a bus 744, the bus bridge 743 may communicate with other devices such as a keyboard/mouse 745, communication devices 746 (such as modems, network interface devices, or other communication devices that may communicate with the computer network 103), audio I/O device, and/or a data storage device 748. The data storage device 748 may store code 749 that may be executed by the processors 702 and/or 704.

In various embodiments of the invention, the operations discussed herein, e.g., with reference to FIGS. 1-7, may be implemented as hardware (e.g., circuitry), software, firmware, microcode, or combinations thereof, which may be provided as a computer program product, e.g., including a machine-readable or computer-readable medium having stored thereon instructions (or software procedures) used to program a computer to perform a process discussed herein. Also, the term "logic" may include, by way of example, software, hardware, or combinations of software and hardware. The machine-readable medium may include a storage device such as those discussed with respect to FIGS. 1-7. Additionally, such computer-readable media may be downloaded as a computer program product, wherein the program may be transferred from a remote computer (e.g., a server) to a requesting computer (e.g., a client) via a communication link (e.g., a bus, a modem, or a network connection).

Reference in the specification to "one embodiment" or "an embodiment" means that a particular feature, structure, or characteristic described in connection with the embodiment may be included in at least an implementation. The appearances of the phrase "in one embodiment" in various places in the specification may or may not be all referring to the same embodiment.

Also, in the description and claims, the terms "coupled" and "connected," along with their derivatives, may be used. In some embodiments of the invention, "connected" may be used to indicate that two or more elements are in direct physical or electrical contact with each other. "Coupled" may mean that two or more elements are in direct physical or electrical contact. However, "coupled" may also mean that two or more elements may not be in direct contact with each other, but may still cooperate or interact with each other.

Thus, although embodiments of the invention have been described in language specific to structural features and/or methodological acts, it is to be understood that claimed subject matter may not be limited to the specific features or acts described. Rather, the specific features and acts are disclosed as sample forms of implementing the claimed subject matter.

The invention claimed is:

1. A device, comprising:

display switching logic to:

transfer an amount of display data over a serial point-to-point interconnect from a frame buffer associated with a discrete graphics controller in a local video memory to a frame buffer associated with an integrated graphics controller in a system memory;

detect an execution of an application, wherein the application is one of a graphics-intensive application or a non-graphics-intensive application; and cause the discrete graphics controller to conserve power in response to execution of the non-graphics-intensive application, wherein one of a stream from the discrete graphics controller or a stream from the integrated graphics controller is to be selected in response to a signal generated by the display switching logic, wherein once a determination is made to switch to the stream from the integrated graphics controller, the discrete graphics controller is to cause a flush of an entire current frame to occur, wherein the display switching logic is to comprise controller logic to generate the signal to cause selection of the stream from the discrete graphics controller or the stream from the integrated graphics controller, wherein the controller logic is to receive the selected stream from the discrete graphics controller or the integrated graphics controller.

2. The device of claim 1, wherein the display switching logic to:

cause the discrete graphics controller to at least partially cease conserving power in response to an indication that the graphics-intensive-application is executing.

3. The device of claim 1, wherein the display switching logic to: switch context for the display data to be operated upon between operating in a discrete graphics controller context and operating in an integrated graphics controller context.

4. The device of claim 3, wherein the display data is displayed at a given frame rate, and wherein the context is switched with substantially no interruption of the given frame rate.

5. The device of claim 1, wherein at least a portion of the display switching logic comprises software logic.

6. The device of claim 1, wherein the display switching logic to: cause the discrete graphics controller to enter into a reduced power consumption state once transfer of the display data from the discrete graphics frame buffer in the local video memory to the integrated graphics frame buffer in the system memory is complete.

7. The device of claim 1, wherein the serial point-to-point interconnect comprises an interconnect compliant to Peripheral Component Interconnect (PCI) Express.

8. The device of claim 1, wherein once the discrete graphics controller detects a need for switching to integrated graphics, the discrete graphics controller may cause a flush to occur.

9. The device of claim 1, wherein once the integrated graphics controller detects a need for switching to discrete graphics, the integrated graphics controller may cause a flush to occur.

10. The device of claim 1, further comprising a multiplexer to select between the stream from the integrated graphics controller and the stream from the discrete graphics controller in response to the signal.

11. The device of claim 1, wherein the discrete graphics controller is to detect a need to switch to the stream from the integrated graphics controller.

12. The device of claim 1, wherein once a determination is made to switch to the stream from the discrete graphics controller, the integrated graphics controller is to cause a flush to occur.

13. The device of claim 12, wherein the integrated graphics controller is to detect a need to switch to the stream from the discrete graphics controller.

14. The device of claim 1, wherein a graphics controller is to comprise the integrated graphics controller and the discrete graphics controller.

15. The device of claim 14, wherein the graphics controller is to be integrated into a system or provided on a separate interface.

16. The device of claim 1, wherein the flush is to occur through a PEG (PCI Express Graphics) port.

17. A system, comprising:

a processor, the processor including an integrated graphics controller;

system memory;

a discrete graphics controller;

local video memory; and display switching logic to transfer an amount of display data over a serial point-to-point interconnect from a frame buffer associated with a discrete graphics controller in a local video memory to a frame buffer associated with an integrated graphics controller in a system memory;

detect an execution of an application, wherein the application is one of a graphics-intensive application or a non-graphics-intensive application; and cause the discrete graphics controller to conserve power in response to execution of the non-graphics-intensive application, wherein one of a stream from the discrete graphics controller or a stream from the integrated graphics controller is to be selected in response to a signal generated by the display switching logic, wherein once a determination is made to switch to the stream from the integrated graphics controller, the discrete graphics controller is to cause a flush of an entire current frame to occur, wherein the display switching logic is to comprise controller logic to generate the signal to cause selection of the stream from the discrete graphics controller or the stream from the integrated graphics controller, wherein the controller logic is to receive the selected stream from the discrete graphics controller or the integrated graphics controller.

18. The system of claim 17, wherein the display switching logic to:

cause the discrete graphics controller to at least partially cease conserving power in response to an indication that the graphics-intensive-application is executing.

19. The system of claim 17, wherein the display switching logic to:

switch context for the display data to be operated upon between operating in a discrete graphics controller context and operating in an integrated graphics controller context.

20. The system of claim 19, wherein the display data is displayed at a given frame rate, and wherein the context is switched with substantially no interruption of the given frame rate.

21. The system of claim 17, wherein at least a portion of the display switching logic comprises software logic.

22. The system of claim 17, wherein the display switching logic to:

cause the discrete graphics controller to enter into a reduced power consumption state once the transfer of the display data from the discrete graphics frame buffer in the local video memory to the integrated graphics frame buffer in the system memory is complete.

23. The system of claim 17, wherein the serial point-to-point interconnect comprises an interconnect compliant to Peripheral Component Interconnect (PCI) Express.

24. A non-transitory machine readable medium to store instructions, which upon execution by a machine, cause the machine to perform a method, comprising:

transferring an amount of display data over a serial point-to-point interconnect from a frame buffer associated with a discrete graphics controller in a local video memory to a frame buffer associated with an integrated graphics controller in a system memory;

detecting an execution of an application, wherein the application is one of a graphics-intensive application or a non-graphics-intensive application; and causing the discrete graphics controller to conserve power in response to execution of the non-graphics-intensive application, wherein one of a stream from the discrete graphics controller or a stream from the integrated graphics controller is to be selected in response to a signal generated by the display switching logic, wherein once a determination is made to switch to the stream from the integrated graphics controller, the discrete graphics controller is to cause a flush of an entire current frame to occur, wherein the display switching logic is to comprise controller logic to generate the signal to cause selection of the stream from the discrete graphics controller or the stream from the integrated graphics controller, wherein the controller logic is to receive the selected stream from the discrete graphics controller or the integrated graphics controller.

25. The non-transitory machine readable medium of claim 24, wherein the performed method further comprises:

causing the discrete graphics controller to exit a reduced power consumption state if the application detected is the graphics-intensive application.

26. The non-transitory machine readable medium of claim 24, wherein the performed method further comprises:

switching context for the display data to be operated upon between operating in a discrete graphics controller context and operating in an integrated graphics controller context.

27. The non-transitory machine readable medium of claim 26, wherein the display data is displayed at a given frame rate, and wherein the context is switched with substantially no interruption of the given frame rate.

28. The non-transitory machine readable medium of claim 24, wherein the performed method further comprises:

causing the discrete graphics controller to enter into a reduced power consumption state once the transferring of the display data from the discrete graphics frame buffer in the local video memory to the integrated graphics frame buffer in the system memory is complete.

* * * * *